US006269539B1

(12) United States Patent
Takahashi et al.

(10) Patent No.: US 6,269,539 B1
(45) Date of Patent: Aug. 7, 2001

(54) FABRICATION METHOD OF CONNECTOR HAVING INTERNAL SWITCH

(75) Inventors: Norihiro Takahashi; Fumio Kurotori, both of Suzaka; Hideo Miyazawa, Yokohama; Osamu Daikuhara; Kazuyuki Futaki, both of Suzaka; Hiroyuki Suzuki, Nagano; Takahiro Yoshiike, Suzaka; Kazuhiko Ikeda, Nagano, all of (JP)

(73) Assignee: Fujitsu Takamisawa Component Limited, Tokyo (JP)

( * ) Notice: Subject to any disclaimer, the term of this patent is extended or adjusted under 35 U.S.C. 154(b) by 0 days.

(21) Appl. No.: 09/356,023

(22) Filed: Jul. 16, 1999

Related U.S. Application Data

(62) Division of application No. 08/822,715, filed on Mar. 24, 1997, now Pat. No. 6,056,590.

(30) Foreign Application Priority Data

Jun. 25, 1996 (JP) ..... 8-164705
Sep. 4, 1996 (JP) ..... 8-234153
Oct. 25, 1996 (JP) ..... 8-283931

(51) Int. Cl.[7] ..... H01R 43/24

(52) U.S. Cl. ..... 29/883; 29/874; 29/876; 29/856; 439/736; 439/405; 439/489

(58) Field of Search ..... 29/883, 884, 885, 29/876, 856, 858, 874, 829; 439/722, 733.1, 736, 405, 491, 606, 489, 188

(56) References Cited

U.S. PATENT DOCUMENTS 4,269,467 * 5/1981 Hughes ..... 339/126 R
4,764,645 * 8/1988 Takasawa ..... 200/16 F
4,790,763 * 12/1988 Weber et al. ..... 439/65
5,213,514 5/1993 Arai ..... 439/79
5,234,356 8/1993 Maejima et al. ..... 439/352
5,639,250 * 6/1997 Neef et al. ..... 439/79
5,651,685 7/1997 Brinkman et al. ..... 439/79
5,761,805 * 6/1998 Guyer ..... 29/833
5,926,952 * 7/1999 Ito ..... 29/833
6,041,498 * 3/2000 Hillbish et al. ..... 29/833
6,059,601 * 5/2000 Hirai et al. ..... 439/405

* cited by examiner

*Primary Examiner*—Lee Young
*Assistant Examiner*—Minh Trinh
(74) *Attorney, Agent, or Firm*—Staas & Halsey LLP

(57) ABSTRACT

A method for fabricating a connector for coupling with a counter connector having an array of pairs of contacts therein includes providing an insulated housing having an array of openings receiving a plurality of first contact modules each having first and second isolated contacts and a second contact module having isolated first and second conducting members respectively having first and second contacts and a terminal, and a third contact and a second terminal, selectively inserted into corresponding openings of the insulating housing such that each of the respective first and second contacts of the first contact modules are connected with the corresponding contact of the counter connector while maintaining the first and second contacts electrically isolated from each other. Further, the second contact modules are inserted into corresponding openings of the insulating housing, not used for the first contact modules and such that the first contact of the second contact module is connected with one contact of the corresponding pair of contacts of the counter electrode and both the second and third contacts are electrically connected with the other contact of the corresponding pair of contacts of the counter electrode when the connector is coupled with the counter connector.

2 Claims, 14 Drawing Sheets

FABRICATION METHOD OF CONNECTOR HAVING INTERNAL SWITCH

This application is a division of application Ser. No. 08/822,715, filed Mar. 24, 1997, now U.S. Pat. No. 6,056, 590.

BACKGROUND OF THE INVENTION

1. Field of the Invention

This invention relates to an electrical connector, particularly to an electrical connector for connecting a plurality of electric circuits by mechanical coupling with a counter electrical connector, and a fabrication method of the connector.

2. Description of the Prior Art

FIGS. 1A through 1C are plan, front, and sectional views of a prior art male connector with a dual-in-line half-pitched contact array for the SCSI specification, respectively. The male connector is composed of an insulating housing 41 encapsulated by a metal shell 42, and a array of contact members 43 inserted into dual-in-line rectangular shaped through-holes 44 of the insulating housing 44. While FIGS. 2A through 2C are plan, front, and sectional views of a prior art dual-in-line female connector, respectively, which mechanically couples with the male connector to make an electric connection as shown in FIGS. 1A through 1C. The female connector is composed of an insulating housing 21, a metal shell 22, an array of pairs of upper and lower contact members 23 inserted into rectangular shaped through-holes 24 to be fixed to the insulating housing 21, and an insulating base 26 having terminal-supporters 25 gaplessly continuous to the insulating housing 21, in which each of the upper and lower contact members 23, made by a metal plate, has a body 30, a pair of spring contacts 28 at a front end of the body with respective opposing contact parts 29, and an L-shaped terminal 27 at a back end. Further, FIGS. 3A and 3B are sectional views of another type of prior art inline male and female connectors, respectively. In both cases, the male connectors shown in FIGS. 1A through 1C and FIG. 3A couple with the female connectors shown in FIG. 2B and FIG. 3B by inserting each of the respective male contacts 43 and 49 thereof into the corresponding female spring contacts 28 and 33 thereof, respectively. Although a pair of the spring contacts of the female connector squeezes the inserted contact of the male connector, incomplete coupling often occurs due to severe jarring or accidental pull of a cable. Such an incomplete coupling of connector may give rise not only to a not simple disconnection of the electric circuits but also to an unrecoverable breakdown of the input circuit due to a sudden increase of an input impedance. For example, if an input terminal is opened while the input circuit is activated, the input circuit is often damaged, particularly an input circuit to an MOSLSI circuit. Therefore, it is desirable that the input circuit is activated after the input terminal is terminated with a proper input impedance by complete coupling of connectors. Further, it may be convenient in some cases that a complete or an incomplete coupling of connectors is correspondingly indicated by a suitable indicator, such as a warning lamp or a signal on a display. Therefore, it is needed to detect whether a coupling of connectors is completed or not. However., either case of the prior art connector has nothing to do for these inconvenience. Of course, the circuit can be protected by some protective circuit, but it incurs no little expense and complex circuits. These inconveniences and requirements must be improved simultaneously to achieve an advanced, improved connector.

SUMMARY OF THE INVENTION

An object of the present invention is to provide a connector having a detector means for detecting whether the connector is coupled or decoupled with the counter connector.

Another object of the present invention is to provide an internal connector which is mounted on an electric instrument having an electric module for changing a state by coupling or decoupling with the external connector.

A further object of the present invention is to provide a connector having an electric switch for changing a state by coupling or decoupling with the counter connector.

Still a further object of the present invention is to provide a method for making a female connector having an electric module for changing a state by coupling or decoupling with the corresponding male connector.

BRIEF DESCRIPTION OF THE DRAWINGS

The present invention will be more apparent from the following description, when taken to conjunction accompanying drawings, in which.

DESCRIPTION OF THE PREFERRED EMBODIMENTS

Reference will now be made in detail to the preferred illustrated embodiments of the invention, examples of which are illustrated in the accompanying drawings. While the invention will be described in conjunction with the preferred illustrated embodiments, it will be understood that it is not intended to limit the invention to these embodiments. On the contrary, the invention is intended to cover alternatives, modifications and equivalents, which may be included within the spirit and scope of the invention as defined by the appended claims.

Although each of the contacts of a dual-in-line connector is already reserved to its respective role determined by the SCSI specification, many electronic instruments usually do not use all of the contacts. Therefore, one of the unused contact members can be replaced by a contact module for the present invention without interfering with the original role of the connector.

Figure 4A:
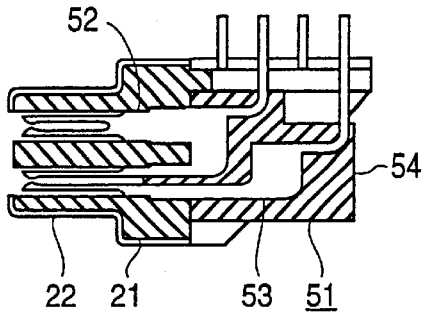
FIGS. 4A through 4C are sectional, plan, and front views, respectively, of a left hand side of a dual-in-line connector with the contact module in accordance with a first embodiment of the invention.
Figure 4B:
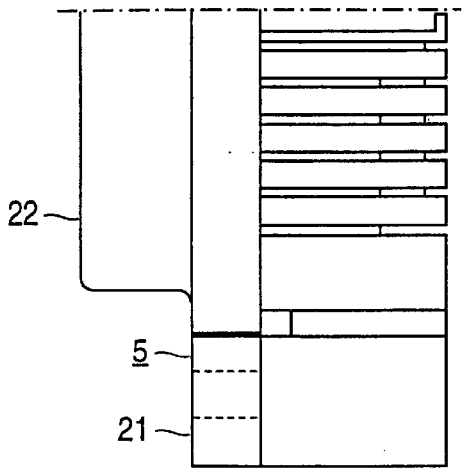
Figure 4C:
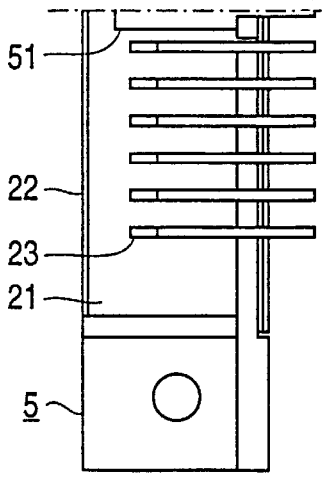

FIGS. 4A and 4C illustrate a dual-in-line connector with both a contact module according to the first embodiment the present invention and also a plurality of contact members.

The connector 5 of the first embodiment has an insulating housing 21 encapsulated by a metal shell 22, into which a contact module 51 and plural, common contact members 23, which may be conventional, are inserted.

FIGS. 5A through 5C, and 5D illustrate a dual-in-line contact module according to the first embodiment of the present invention, and an insulating housing of the dual-in-line connector, respectively.

Figure 5A:
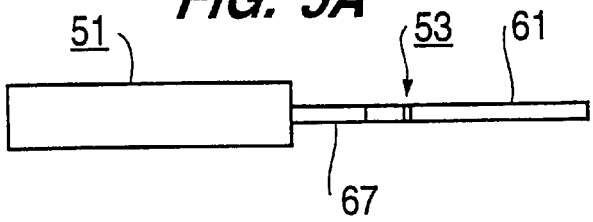
FIGS. 5A through 5C and 5D are plan, sectional, sectional and a front views of a contact module according to a first embodiment of the present invention and a sectional view of a housing for the contact module, respectively.
Figure 5B:
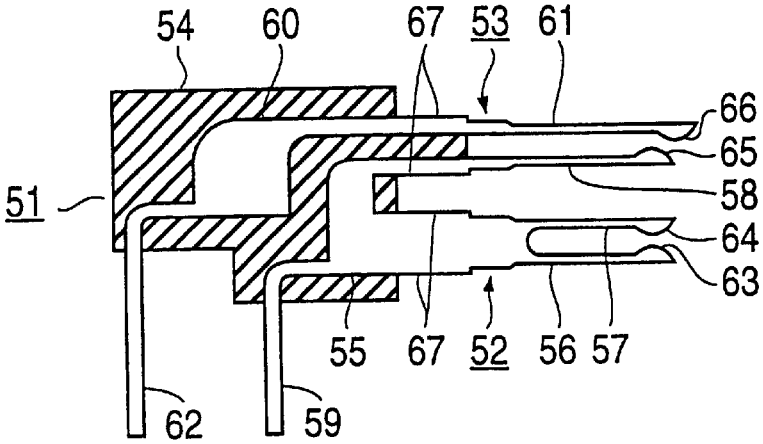
Figure 5C:
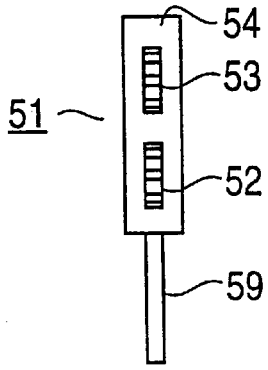
Figure 5D:
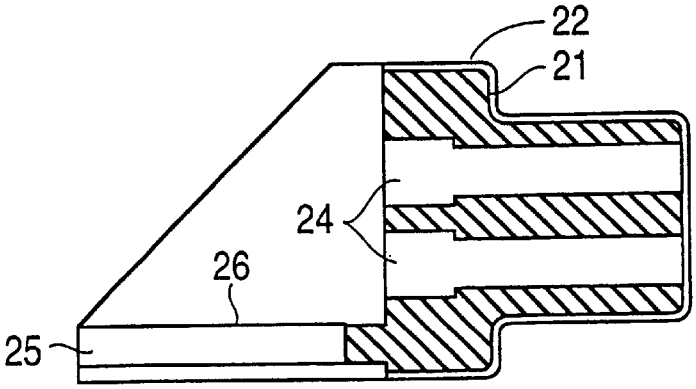

As shown in FIG. 5D, the insulating housing 21 encapsulated by a metal shell 22 has an array of a pair of upper and lower openings 24 arranged along respective upper and lower parallel dual lines, into which a plurality of the conventional contact members 23 and at least one contact module 51 of the present invention are to be engaged. Further, an insulating base 26 having a plurality of terminal supports 25 is gaplessly continuous to the insulating housing 21. Each of the insulating base 26 is positioned under a corresponding opening 24. The contact module 51, as shown in FIGS. 5A through 5C, is composed of first and second spring contact members 52, 53 made of metal and an insulating mold 54 separating the first and second spring contact members 52, 53 by a certain distance from each other by molding both bodies 55,60. The first spring contact member 52 is continuously (i.e., integrally) composed of a body 55, three substantially parallel spring contacts 56,57,58 and an L-shaped terminal 59, which are extended forward and backward from the body 55, respectively. The second spring contact member 53 is also continuously (i.e., integrally) composed of a body 60, a spring contact 61 and an L-shaped terminal 62, extended forward and backward from the body 60, respectively. The second spring contact member 53 is separated from the first spring contact member 52 by a certain distance by the insulating mold 54 such that both are opposing to each other, side by side. A contact part 63 of the first spring contact 56 is opposing to a contact part 64 of the second spring contact 57, while contact part 65 of the third spring contact 58 is opposing to a contact part 66 of the fourth spring contact 61. To mount the contact module 51 to the housing 21 and metal shell 22, both first and second spring contact members 52, 53 are inserted into the corresponding openings 24 such that bezels 67 formed in each by opposite sides of the bodies 55 and 60 cut into internal walls of the openings in order to prevent the inserted spring contact members from coming out of the openings. The contact module 51 replaces a selected pair of the upper and lower contact members 23, which are unused in a female connector 5, by removing the existing pair of contact members 23 from the respective pair of openings 24 and inserting the contact module 51 into that selected pair of openings 24, as shown in FIGS. 4A through 4C.

Figure 6A:
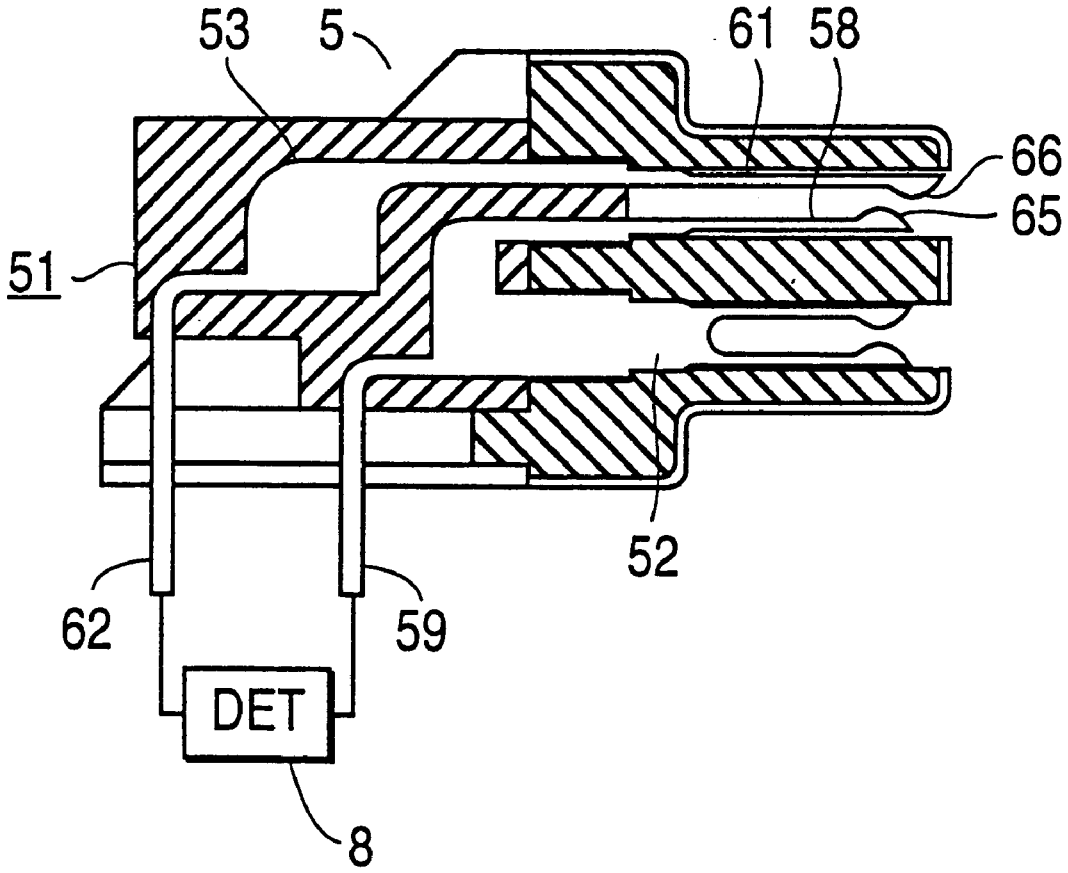
FIG. 6A and 6B are sectional views of a female connector with the contact module according to the first embodiment of the present invention and of a counter connector, respectively.
Figure 6B:
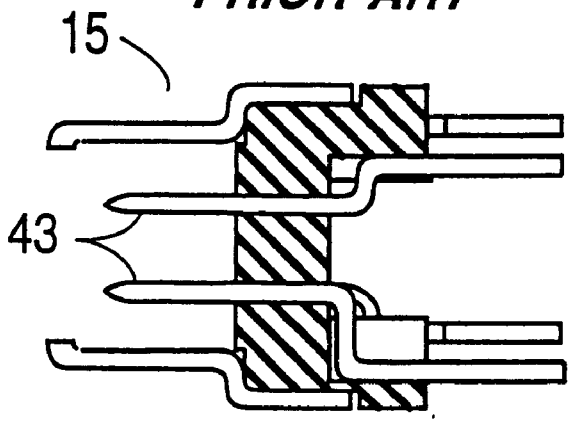
FIG. 6B PRIOR ART

FIG. 6A and 6B are sectional view s of a female connector 5 with the contact module 51 according to the first embodiment: of the present invention and of a counter (mode) connector 15, respectively.

Figure 13:
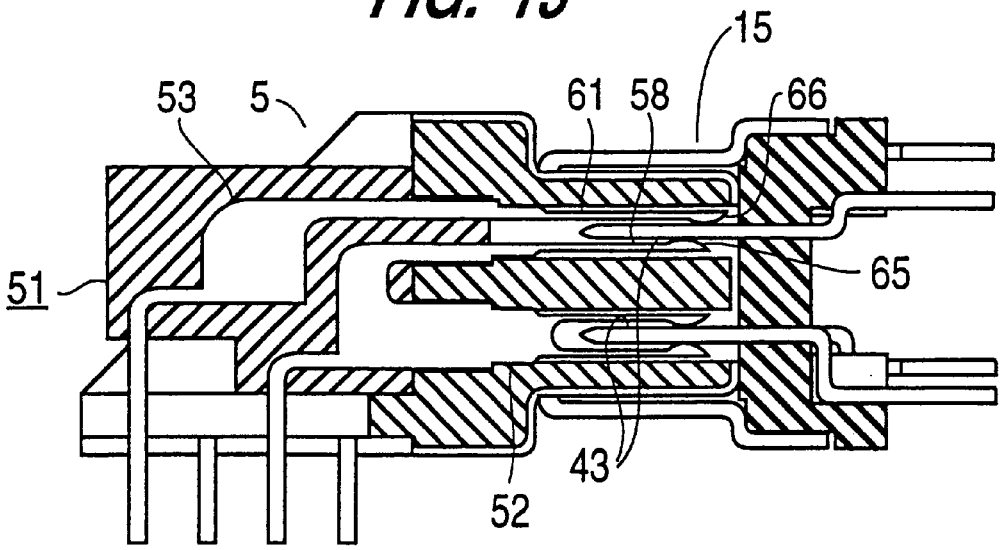
FIG. 13 is a sectional view of the female connector with contact module in FIG. 6A as coupled, or assembled, with the counter connector of FIG. 6B.

Thus, the female connector 5 with the contact module 51 of FIG. 6A can be coupled with a conventional male connector 15 of FIG. 6B as shown in FIG. 13. When the male connector 15 is inserted into the female connector 5 with the contact module 51, a pair of the upper and lower contacts 43 of the male connector 15 are shorted by the first contact member 52, and the third spring contact 58 of the first contact member 52 is shorted to the forth spring contact 61 of the second contact member 53. Therefore, for instance, with a detecting circuit 8 is connected between the first contact member 52 and the second contact member 53, it can be known by the electric short between both members due to an insertion of a pair of the contacts 43 that a coupling between the male connector 15 and the female connector with the contact module is carried out. A slight difference in the opposing position between the contact part 65 of the third spring contact 58 and the contact part 66 of the forth spring contact 61 avoids instability in an ON or OFF state due to chattering during transition between coupling and decoupling.

FIGS. 7A through 7D illustrate a dual-in-line contact module and its housing according to the second embodiment of the present invention, which is a modified case of the first embodiment of the present invention.

Figure 7A:
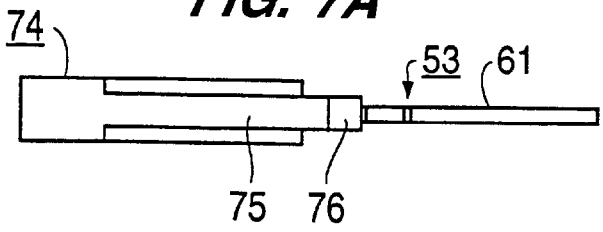
FIGS. 7A through 7D are plan, sectional, and front views of a contact module and a sectional view of a housing according to a second embodiment of the present invention, respectively.
Figure 7B:
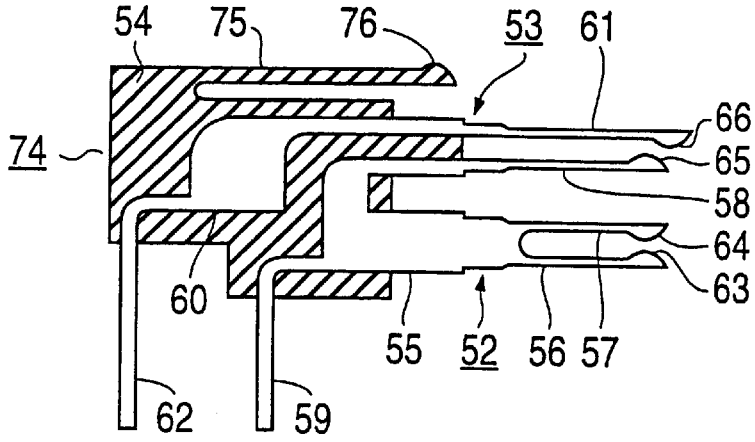
Figure 7C:
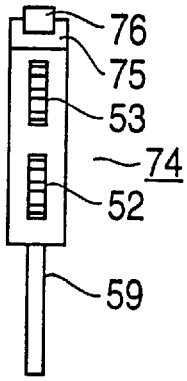
Figure 7D:
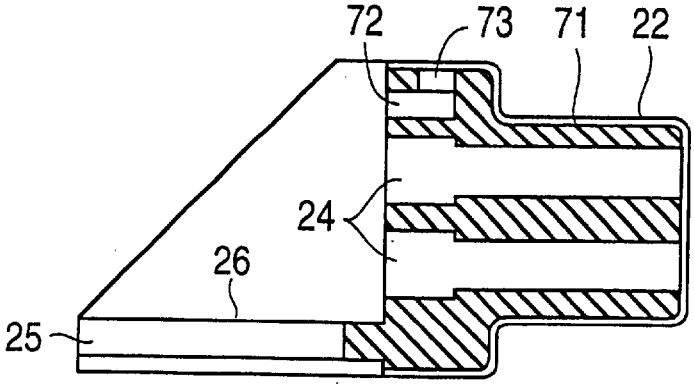
Figure 14:
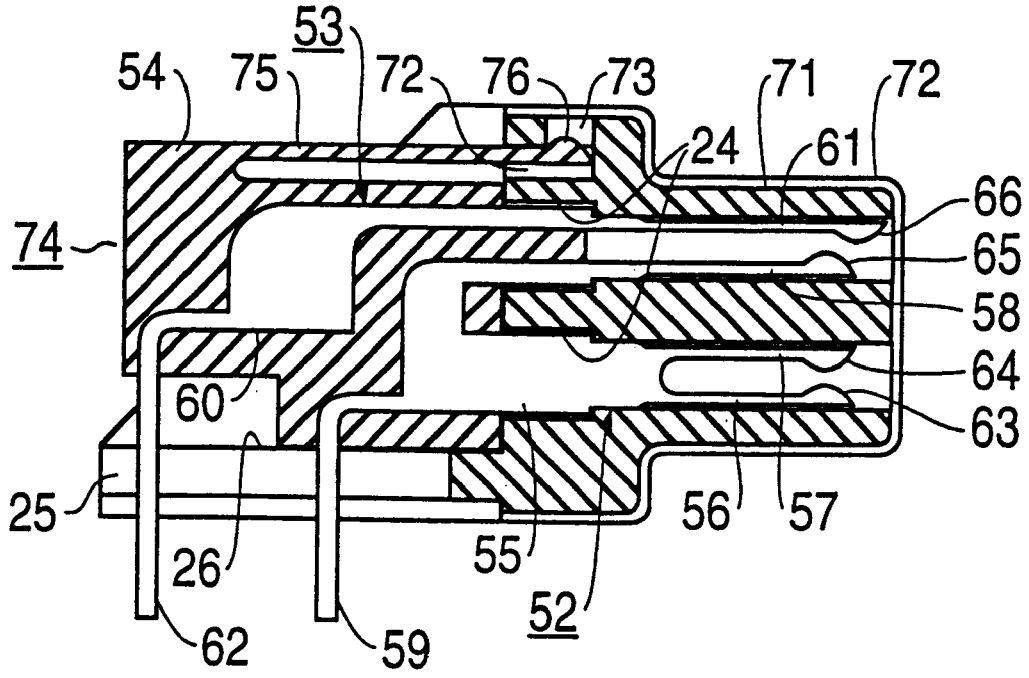
FIG. 14 is a sectional view of the contact module of FIG. 7B assembled with the associated housing therefore of FIG. 7B, in accordance with the second embodiment of the present invention, and further as coupled, or assembled, with the male counter connector of FIG. 6B.

The modified contact module 74 of FIGS. 7A, 7B and 7C has a mold spring 75 (i.e., molded integrally with) having a latch 76 on the upper part of the original contact module 51, other parts and functions of which are the same as those of the original contact module 51. The housing 71 engaged into the shell 22 as shown in FIG. 7B has a third opening 72 for receiving the mold spring 75 of the modified contact module and an empty space 73 for receiving the latch 76 of the mold spring 75 in addition to a pair of the upper and lower openings 24 as shown in FIG. 14. The mold spring 75 and latch 76 fasten the modified contact module 74 to the housing 71 to prevent the modified contact module 74 from coming out of the housing 71 when the male connector is coupled to the female connector as also shown in FIG. 14. A clearance between the first and second contact members must be accurate, otherwise, a contact pressure of squeezing the contact 43 between the contact part 65 of the first spring contact 58 and the contact part 66 of the second spring contact 61 becomes unstable. Therefore, an accuracy in this clearance is essential for the contact module for the present invention. For this purpose, a novel fabrication method for contact module has been developed as described below.

Figure 8A:
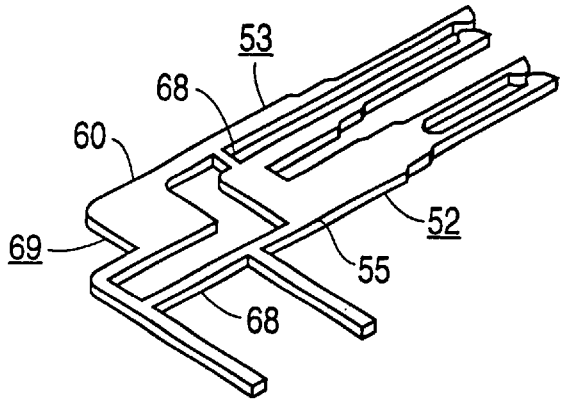
FIGS. 8A through 8C are perspective views of a contact module in various steps of fabrication according to a third embodiment of the present invention, respectively.
Figure 8B:
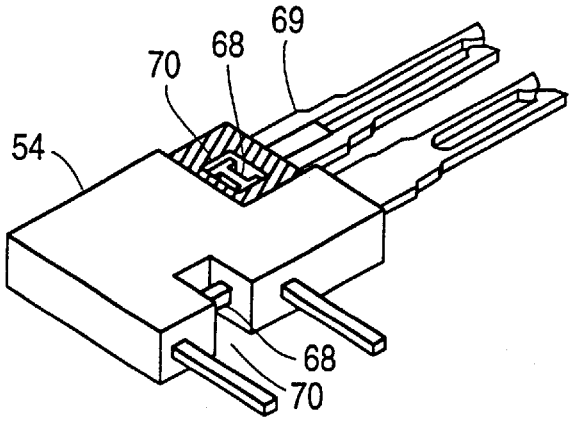
Figure 8C:
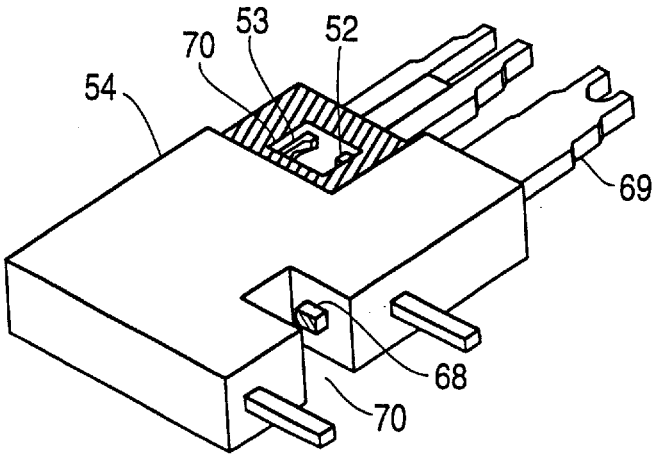

FIGS. 8A through 8C are bird (i.e., perspective, elevational) views of a contact module in various steps of fabrication according to the third embodiment of the present invention, respectively.

As a first step of the fabrication process, as shown in FIG. 8A, a monolithic metal frame 69 is provided, in which patterns of the first and second contact members 52, 53 are connected to each other by bridges 68 such that an accurate clearance is maintained between both contact members. Next, as shown in FIG. 8B, a part of the monolithic metal frame 69, mainly the bodies 55, 60 and their neighboring regions, is fixed with an insulating mold 54 by an insert mold technique such that the bridges 68 are exposed in respective windows 70. Finally, as shown in FIG. 8C, the bridges 68 are cut off in each of the windows 70, which results in both contact members being electrically isolated while still maintained with accurate clearance between them. The fabrication method described above has ensured reproducibility in the precise clearance and manufacturability in commercial production.

Figure 1A:
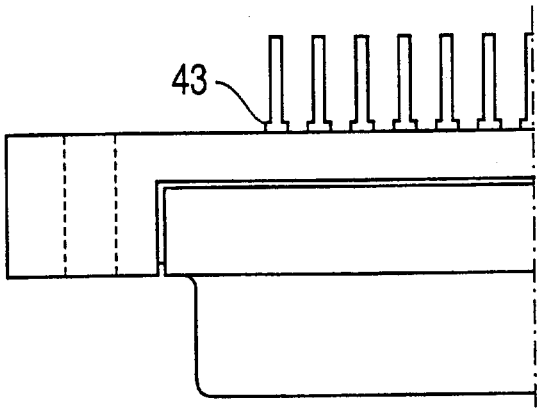
FIG. 1A PRIOR ART
FIGS. 1A through 1C are plan, sectional, and front views, respectively of a prior art male connector with a dual-in-line half-pitched contact array in conformity with the SCSI specification.
Figure 1B:
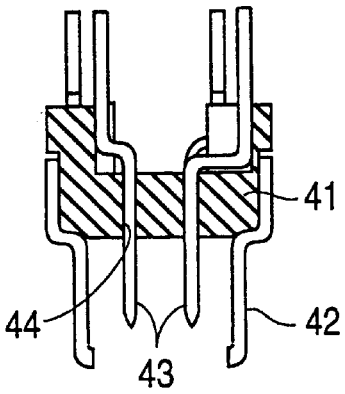
FIG. 1B PRIOR ART
Figure 1C:
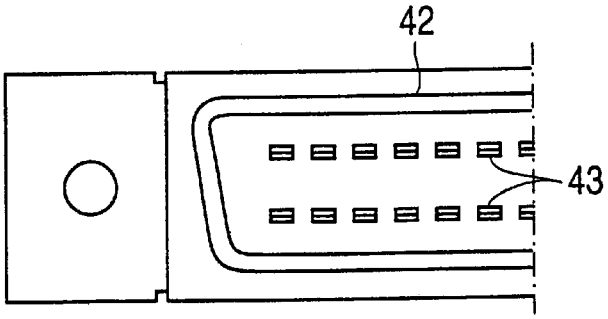
FIG. 1C PRIOR ART
Figure 2A:
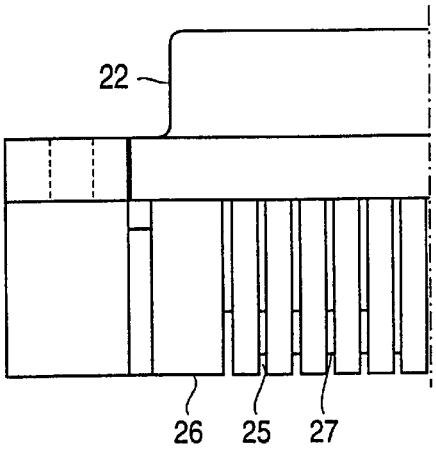
FIG. 2A PRIOR ART
FIGS. 2A through 2C are plan, sectional, and front views, respectively, of a prior art dual-in-line female connector.
Figure 2B:
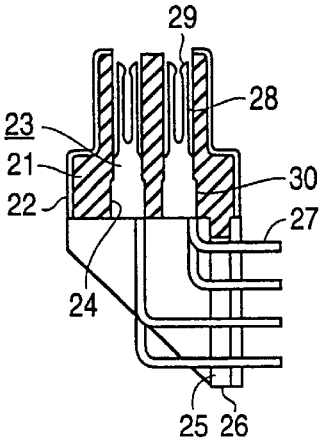
FIG. 2B PRIOR ART
Figure 2C:
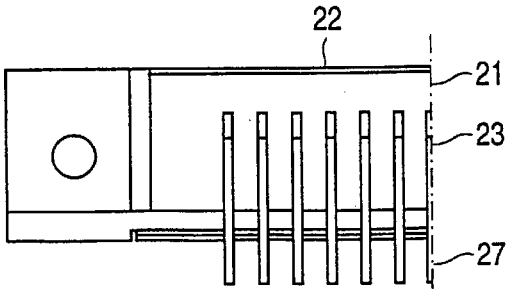
FIG. 2C PRIOR ART
Figure 3A:
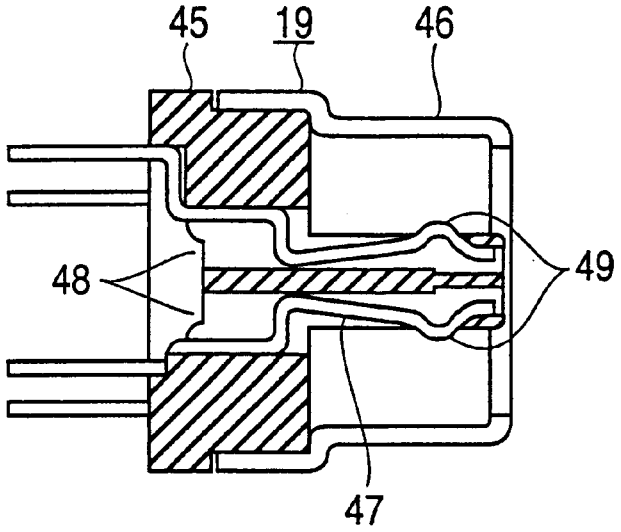
FIG. 3A PRIOR ART
FIGS. 3A and 3B are sectional views, respectively, of another type of prior art in-line male and female connectors.
Figure 3B:
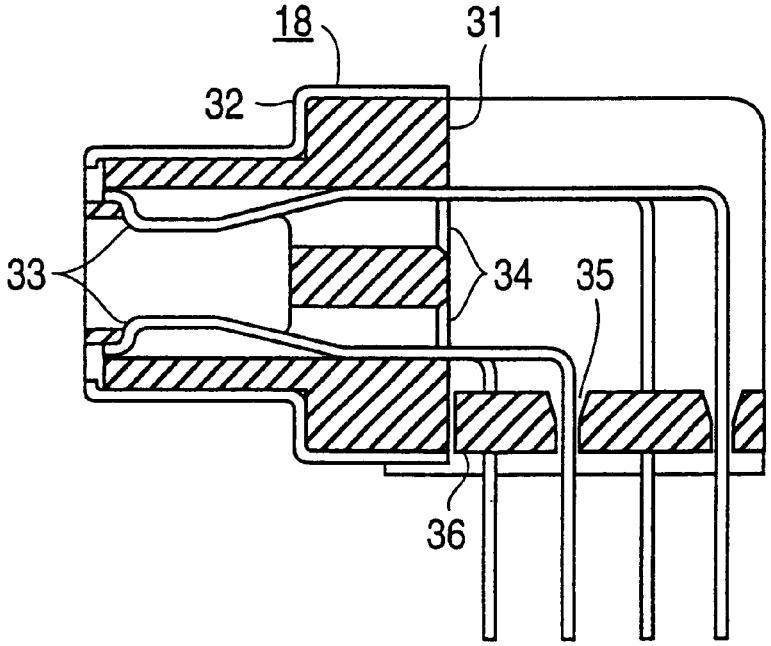
FIG. 3B PRIOR ART

FIGS. 3A and 3B are sectional views of another type of prior art in-line male and female connectors, respectively.

A female connector 18 has an insulating housing 31 engaged into a shell 32, in which each of contact members 33 is inserted into the respectively corresponding one of the prior of upper and lower opening 34, arranged in parallel. Each of contact members 33 has a terminal extended downwardly through a through-hole 35 of an insulating base 36. The insulating base 36 is gaplessly continuous to the insulating mold 31. While a counter male connector 19 is composed of an insulating mold 45 encapsulated by a metal shell 46 and a pair of spring contacts 47 having respective contacts 49, each of which is engaged in one of a pair of through-holes 48 of the insulating mold 45. The pair of spring contacts 47 are isolated from each other by an insulating wall therebetween.

Figure 9A:
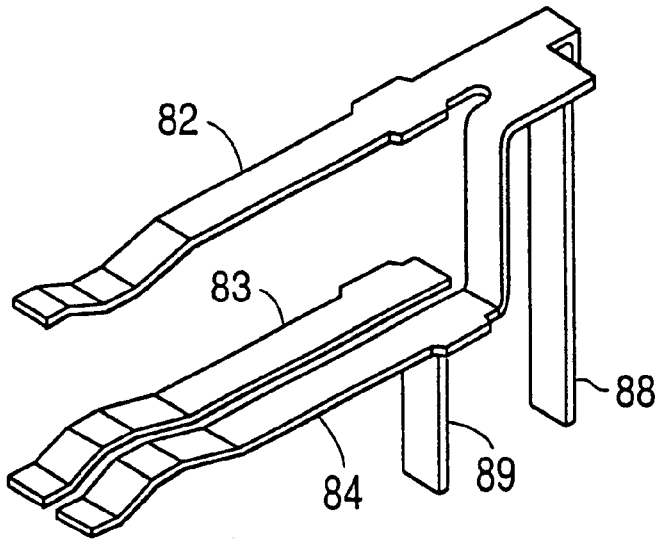
FIGS. 9A and 9B are perspective views of a contact module in various steps of fabrication according to a forth embodiment of the present invention, respectively.
Figure 9B:
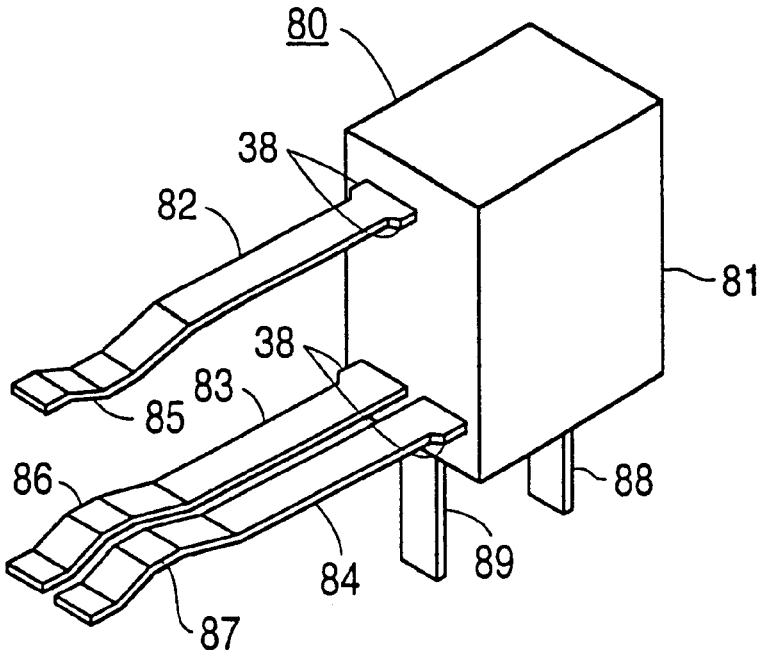

FIGS. 9A and 9B are bird (i.e., elevational, perspective) views of a contact module in various steps of fabrication according to the fourth embodiment of the present invention, respectively.

The contact module 80 shown in FIG. 9B according to the fourth embodiment, is to be mounted on the conventional connector 18 shown in FIG. 3B. As shown in FIG. 9A, the spring contacts 82, 84, are continuous to the terminal 88, while the spring contact 83 is continuous to the terminal 89. As shown in FIG. 9B, an insert mold 81 fixes relative dimensions of the spring contacts and the terminals to one another such that three spring contacts 82, 83, 84 extend horizontally out of one side and two terminals 88, 89 extend downwardly out of a bottom side. Thus, the contact module 80 can be mounted on the female connector 18 by replacing an unused one of contact members 33 such that each of the spring contacts 82, 83, 84 and terminals 88, 89 are inserted into the openings 34 and the through holes 35, respectively. When the spring contacts 82, 83, 84 are inserted into the openings 34, bezels 38, formed in each root, cut into the internal side walls of the openings, by which the contact module 80 is prevented from coming out of the connector 18.

Figure 10A:
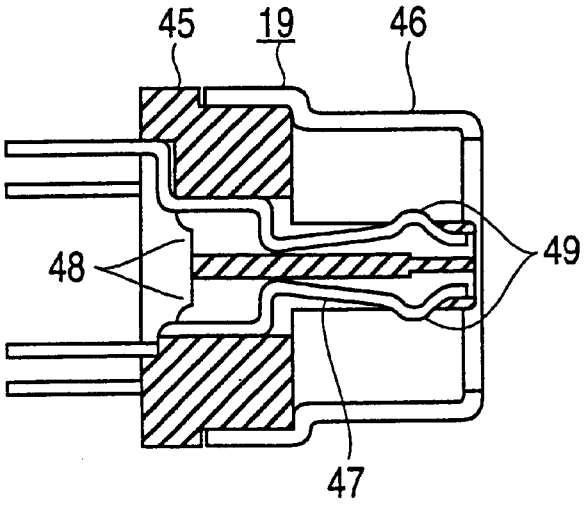
FIGS. 10A and 10B are sectional views of a conventional male connector and female connector having a contact module according to the fourth embodiment of the present invention, respectively.
Figure 10B:
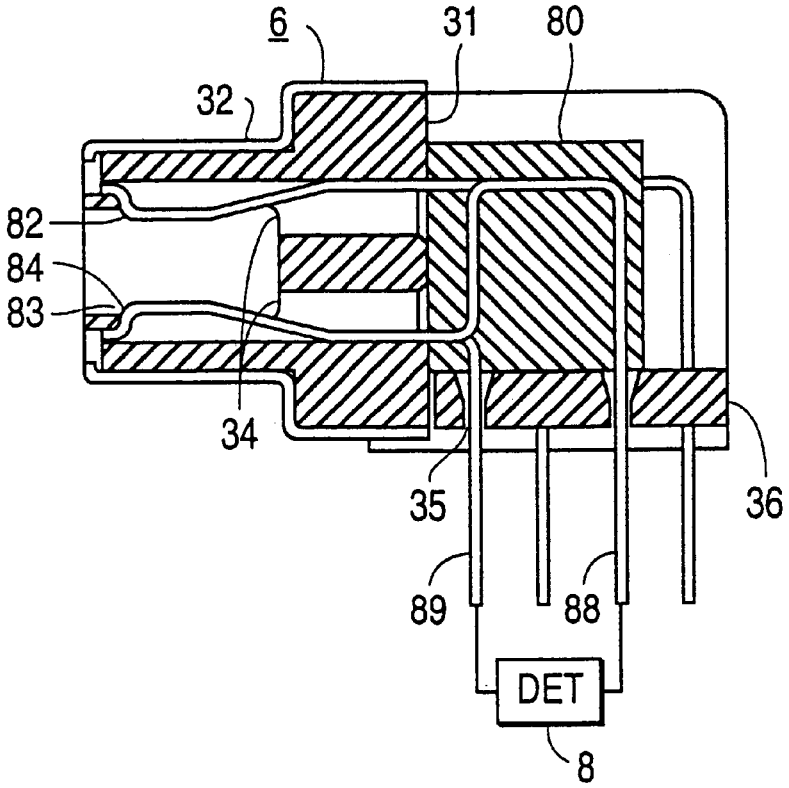

FIGS. 10A and 10B are sectional views of a conventional male connector and female connector having a contact module according to the fourth embodiment of the present invention, respectively.

Since the contact module 80 has the same spring contacts as those of the replaced contact member 33, the female connector 6 having the contact module 80 can be coupled with the conventional male connector 19 without any mechanical problem. Therefore, when the conventional male connector 19 shown in FIG. 10A is coupled with the female connector 6 shown in FIG. 10B having the contact module 80, the upper and lower spring contacts 47 are shorted by the fifth spring contact 82 and the seventh spring contact 84, while the sixth spring contact 83 and the seventh spring contact 84 are shorted by the lower spring contacts 47, and it eventually shorts between the terminals 88 and 89. With the terminals 88 and 89 connected to a detection circuit 8, the electric short of them can be recognized as an insertion of the male connector 19.

Figure 11A:
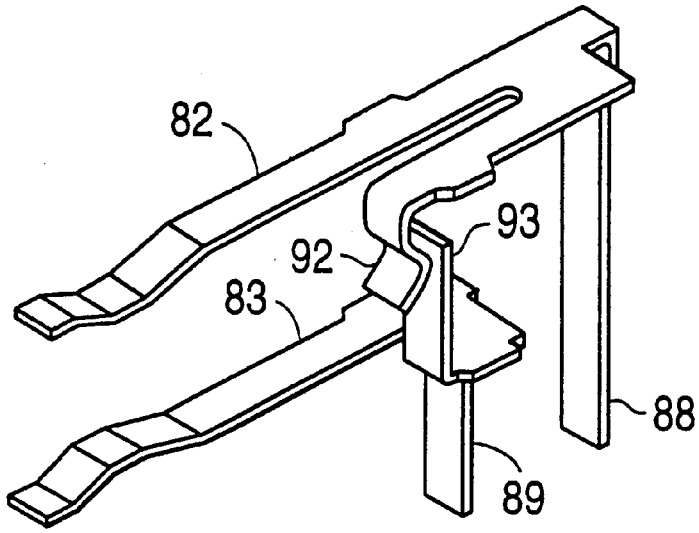
FIGS. 11A and 11B are perspective views of a contact module in various steps of fabrication according to the fifth embodiment of the present invention, respectively.
Figure 11B:
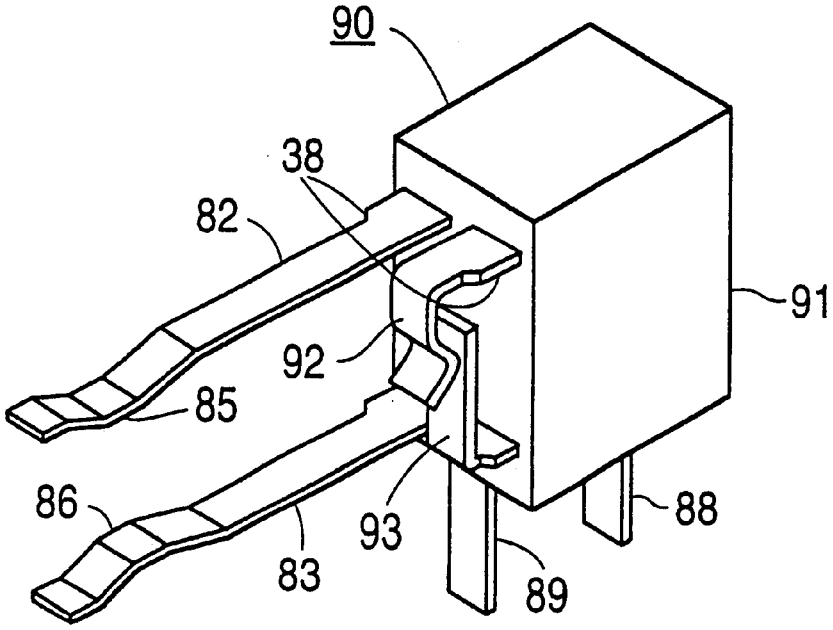

FIGS. 11A and 11B are bird (perspective, elevational) views of a contact module in various steps of fabrication according to the fifth embodiment of the present invention, respectively.

A contact module according to the fifth embodiment of the present invention affords another example of the female connector 6 which can be coupled with the conventional male connector 19. The contact module has an insulating mold 91 from which a fifth spring contact 82 and a sixth spring contact 83, and first and second shorting contacts 92, 93 stick out of the same front wall. The spring contact 82 and the sixth spring contact 83 have contacts 85, 86 opposing to each other, respectively. As shown in FIG. 11A, the first and second shorting contacts 92, 93 are connected to the fifth spring and sixth spring contacts 82, 83, respectively. A terminal 88 of the fifth spring 82 and a terminal 89 of the sixth spring 83 extend out of the bottom side of the insulating mold 91.

Figure 12A:
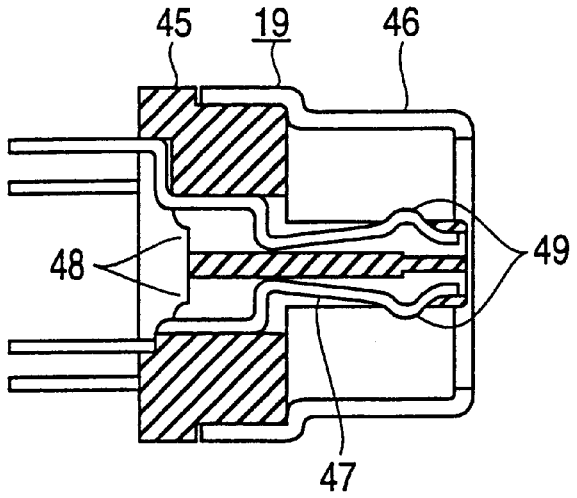
FIGS. 12A and 12B are sectional views of a conventional male connector and a female connector having a contact module according to the fifth embodiment of the present invention, respectively.
Figure 12B:
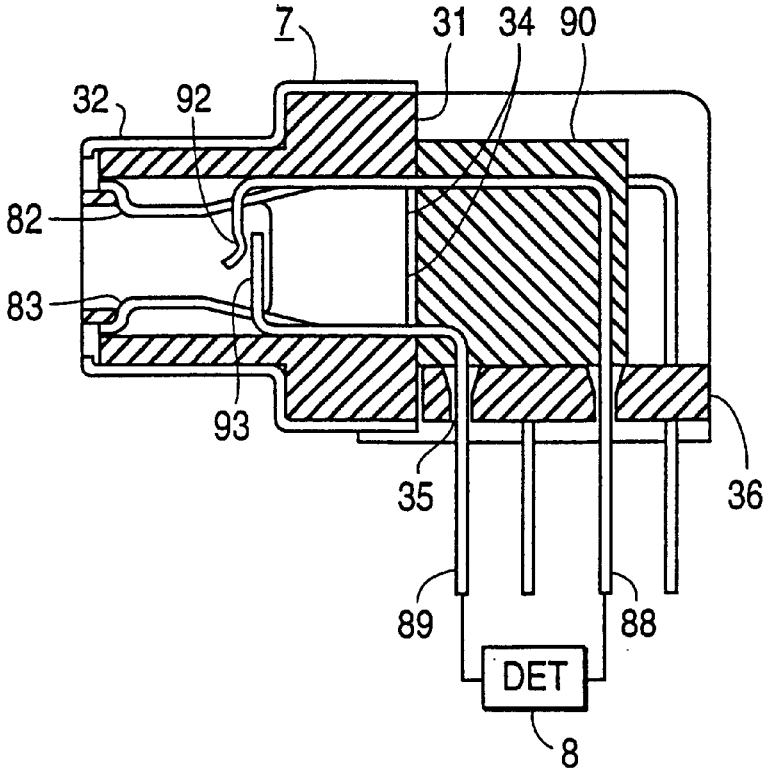

FIGS. 12A and 12B are sectional views of a conventional male connector and female connector having a contact module according to the fifth embodiment of the present invention, respectively.

As shown in FIG. 12B, the female connector 7 has an insulating housing 31 and a metal shell 32, where at least a contact module 90 and a plurality of conventional contact members 33 (not shown) are inserted into upper and lower openings 34 of the insulating housing 31(a partition between the upper and lower openings are not shown). An insulating base 36 having holes corresponding to the upper and lower openings 34 is continuous to a lower part of the insulating housing 31. The spring contacts 82, 83 of the contact module 90 have a bezel 38 in each root so that the bezel eats into the side wall of each opening 34 when the contact module 90 is inserted into the opening 34 to prevent the spring contacts 82, 83 from coming out of the opening 34 easily. If the insulating wall of the openings 34 is removed, the contact module 90 can replace one of the contact members without any mechanical problem, which can receive a pair of the spring contacts 49 of the conventional male connector 19.

Thus, when the male connector 19 couples to the female connector 7, the spring contacts 47 are, separately and individually, electrically connected to the fifth and sixth contacts 82, 83, respectively, and the first shorting contact 92 is pushed by the housing 45 of the male connector 7 toward the second shorting contact 93, such that the first shorting contact 92 and the second shorting contact 93 are eventually shorted. With a detector circuit 8 connected between the terminals 88 and 89 of the fifth and sixth contacts 82 and 83, respectively the coupling of the male connector 19 with the female connector 7 is electrically detected.

As described above, the contact module according to the present invention is easily replaceable for one of the unused standard contact members in a female connector, and thus modified female connector, incorporating the contact module of the invention, maintains a capability to couple with the conventional counter male connector, exactly the same as before.

Although the illustrated embodiments show only such cases that the internal switch mounted in the contact module flips from an OFF state to an ON state by insertion of the male connector, the insertion of the male connector may be equally well detected by, instead, changing a state of the internal switch from ON to OFF.

What is claimed is:

1. A method for fabricating a connector for coupling with a counter connector having an array of pairs of contacts, comprising the steps of:

providing an insulating housing having an array of openings, a plurality of first contact modules each of which has first and second contacts isolated from each other, and a second contact module having first and second conducting members isolated from each other, wherein the first conducting member has first and second contacts and a first terminal and the second conducting member has a third contact and a second terminal;

inserting each of the first contact modules into the corresponding one of the openings of the insulating housing such that each of the respective first and second contacts of the first contact modules are connected with the corresponding contact of the counter connector and maintaining the first and second contacts electrically isolated from each other when the connector couples with the counter connector; and inserting the second contact modules into corresponding openings of the insulating housing not used for any of the first contact modules, such that the first contact of the second contact module is connected with one contact of the corresponding pair of contacts of the counter connector and both the second and third contacts are electrically connected with the other contact of the corresponding pair of contacts of the counter connector when the connector is coupled with the counter connector, wherein the step of providing the second contact module comprises the substeps of:

making a conducting frame having the first and second conducting members connected with each other by a suspension lead such that the second and third contacts are maintained at such a predetermined distance therebetween that the corresponding contact of the counter connector is inserted between the second and third contacts, maintaining an electric contact with each of the second and third contacts when the connector is coupled with the counter connector, molding the conducting frame in an insulator body by an inserting mold technique such that the contacts, terminal, and suspension lead are exposed, and after the molding step, cutting the suspension lead off without cutting any portion of the insulator such that the first and second conducting members are isolated from each other while maintaining the second and third contacts with the predetermined distance therebetween.

2. A method according to claim 1, wherein the molding step further comprises forming a window in the insulator body through which the suspension lead is exposed.

* * * * *